United States Patent [19]

Cuffe

[11] 4,226,171

[45] Oct. 7, 1980

[54] MANUFACTURE OF PAPER TUBES

[76] Inventor: Michael Cuffe, Flat 6, 26 E. Crescent St., McMahons Point, New South Wales 2060, Australia

[21] Appl. No.: 923,069

[22] Filed: Jul. 10, 1978

[30] Foreign Application Priority Data

Jul. 15, 1977 [AU] Australia ..... PD0866

[51] Int. Cl.[3] ..... B31C 3/00

[52] U.S. Cl. ..... 93/81 MT; 93/39.2

[58] Field of Search ..... 93/81 R, 81 MT, 39.2, 93/44.1 R

[56] References Cited

U.S. PATENT DOCUMENTS 3,105,421 10/1963 Petri ..... 93/81 MT 3,518,923 7/1970 Buchholz et al. ..... 93/81 R X 3,777,631 12/1973 Trask ..... 93/81 R

*Primary Examiner*—Robert D. Baldwin

[57] ABSTRACT

The machine supports a roll of paper from which tubes are formed and ejected continuously. The machine includes a turret having a predetermined number of paper tube forming spindles mounted in and supported therearound. The turret is adapted and arranged to be positioned so that one paper tube forming spindle is positioned in a tube forming position with relation to a paper drive roller to form a paper tube. The turret is rotatable to move the spindle away from said tube forming position into a tube ejection position in engagement with a tube ejection means for ejection of the formed tube from the spindle.

11 Claims, 9 Drawing Figures

MANUFACTURE OF PAPER TUBES

This invention relates to the manufacture of paper tubes of various diameters and lengths and wherein one end of each tube, as it is formed, is folded inwardly of the tube, i.e. crimped.

The object of the invention is to provide a machine for manufacturing paper tubes and for providing paper tubes so formed, which are particularly adapted for use as preformed wrappers for coins for example, such as the six different sizes of coins presently in use in Australia.

A further object of the invention is to provide a machine for manufacturing paper tubes which is fully automatic in operation once the machine is set in motion. The machine is particularly suitable for operation by unskilled persons such as junior employees in banking establishments and the like. The tubes formed by the machine are, as stated, crimped at one end and after filling, the other end of the tube is folded in manually or by a crimping device. Also the machine has been designed whereby it is light in weight and can be readily, manually moved from place to place.

Figure 1:
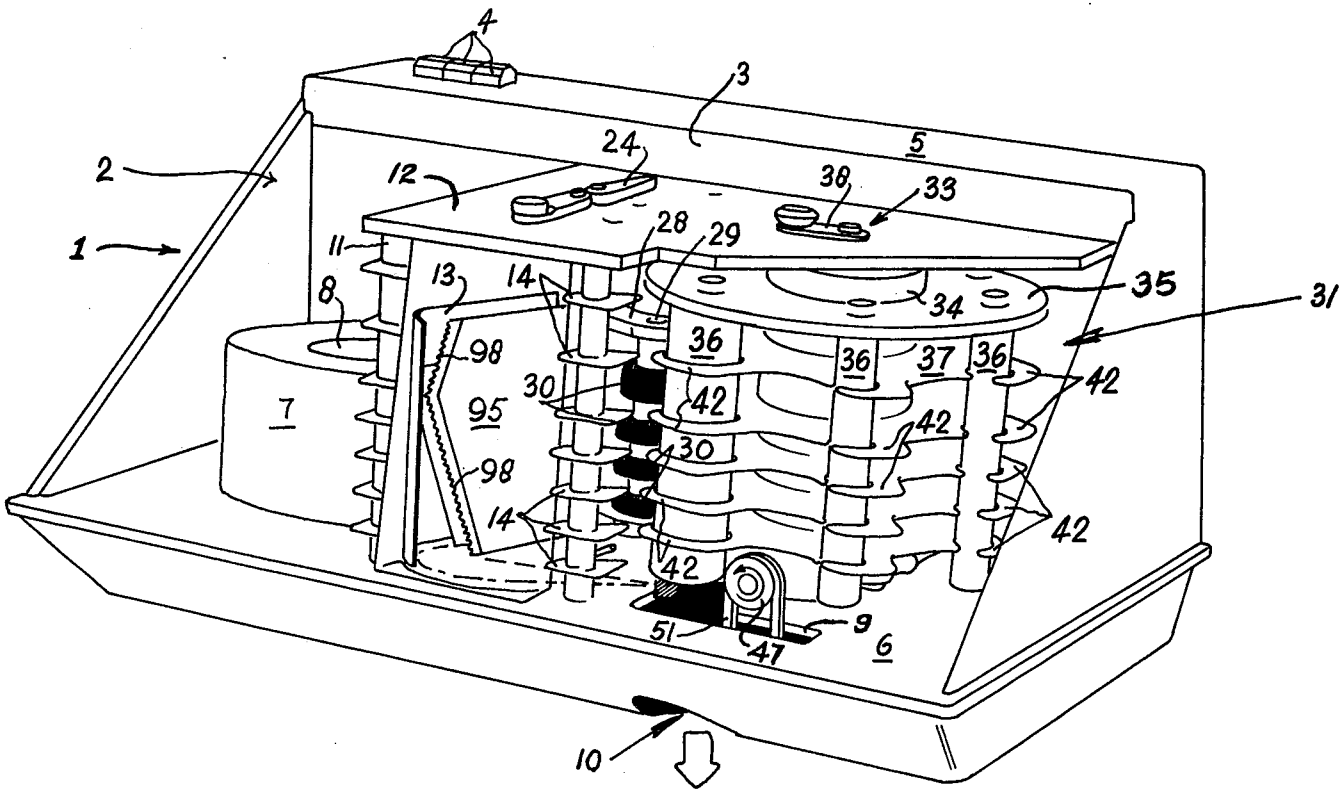
FIG. 1 is a perspective view of a machine according to the invention, in which the turret is adapted to be moved to and fro between tube forming and tube ejection positions.

Referring to the embodiment of the invention illustrated in FIG. 1, the machine is housed in a cabinet 1 which includes an open front 2 adapted to be closed by a transparent cover (not shown), which is hingeably mounted upon the cabinet wall 3.

Control buttons 4 are mounted upon the top 5 of the cabinet 1, and said cabinet 1 also includes a floor 6 upon which a roll of paper 7 is rotatably mounted upon a suitable spindle indicated at 8. The floor 6 has an opening 9 formed therethrough, through which tube crimping means and tube ejection means—both to be described—project. Also, the opening 9 communicates with another opening 10 formed in the lower part of the cabinet 1, through which formed and crimped tubes are ejected.

Figure 2:
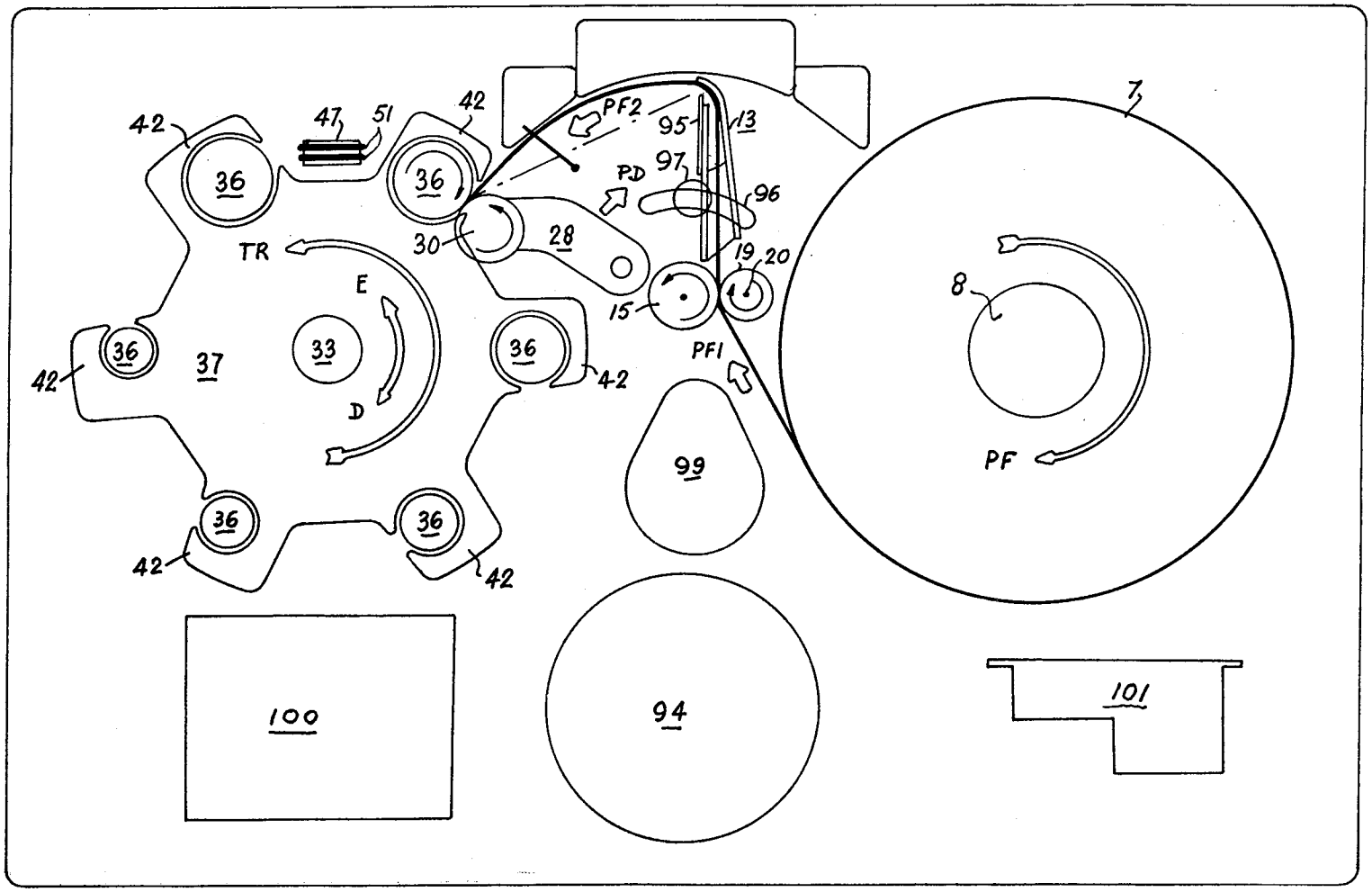
FIG. 2 is a schematic plan view of the components of the machine of FIG. 1.
Figure 4:
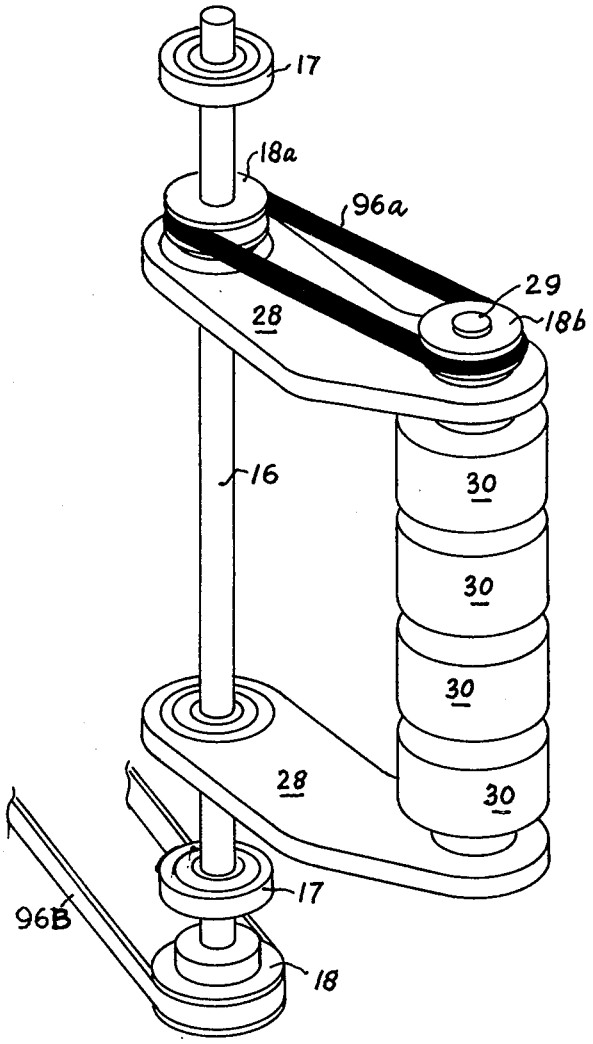
FIG. 4 is a fragmentary perspective view of the mounting of the paper drive roller shaft.
Figure 4A:
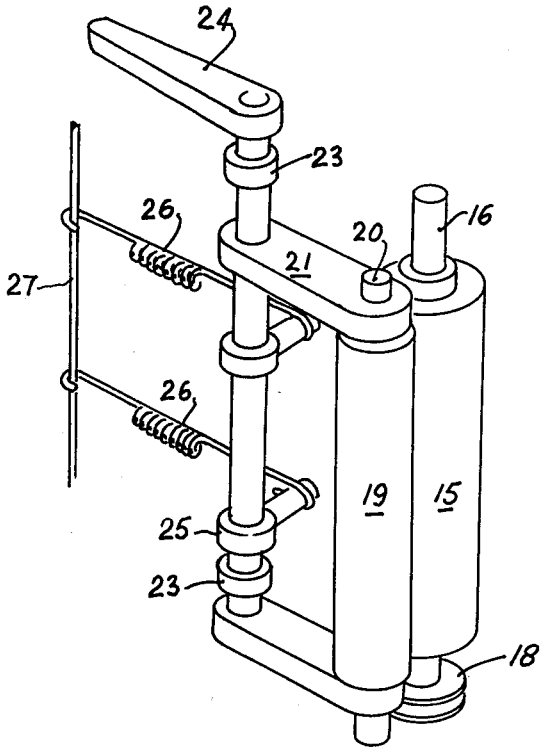
FIG. 4A is a fragmentary perspective view showing the paper feed rollers and their mounting and operating means.

The cabinet floor 6 supports pedestals 11, two of which are shown, which in turn support a top plate 12. A curved paper guide 13 is also supported upon the floor 6 and one of the pedestals 11. The right hand pedestal seen in FIG. 1, has paper guides 14 mounted thereon in vertically spaced relationship. Also a paper feed roller 15 (FIG. 2) is supported on a shaft 16 (FIG. 4) running in bearings 17 mounted in the top plate 12 and the floor 6, and the shaft 16 has a pulley 18 on the lower end thereof located beneath floor 6, see FIG. 4. A second paper feed roller 19 is mounted on a shaft 20 which is supported by the floor 6 and this shaft 20 is connected by links 21 (FIG. 4A) to a roller release shaft which is supported in bearings 23 in the top plate 12 and in the floor 6. The upper end of the last-mentioned shaft has a control lever 24 fixed thereon and beyond the links 21. This said shaft has brackets 25 fixed thereon. Each bracket 25 has a spring 26 connected thereto and the springs 26 are connected at the other end thereof to a rod 27 fixed to the top plate and to the floor 6. The springs 26 normally retain the roller 19 in frictional engagement with roller 15. The roller 19 is disengaged from roller 15 by actuation of the control lever 24, against the action of the springs 26.

A pair of arms 28 (FIG. 2) which are pivotally supported on the shaft 16, carry a paper driver roller shaft 29. The arms 28 are spring biassed to the position shown in FIG. 2 as indicated by arrow PD. The shaft 29 carries a predetermined number of vertically spaced paper drive rollers 30 and the rollers 30 are normally in engagement with a paper tube forming spindle forming part of a turret also to be explained.

A turret generally indicated by reference 31, FIG. 1 is supported vertically by and between the top plate 12 and floor 6. It includes a turret shaft 33, a plurality of spaced rings 34 mounted on the shaft 33, a turret head 35 clamped between the upper two rings 34, in this embodiment six paper tube forming spindles 36 secured to and around the head 35 in desired spaced relationship and depending downwardly therefrom, and five paper guides 37 clamped between the remaining rings 34.

The shaft 33 projects at its upper end through the top plate 12 and has a turret positioning handle 38 fixed thereon. At its lower end, the shaft 33 carries a disc 39 (FIG. 3) which is rotatably mounted on the floor 6 of the cabinet 1.

Figure 3:
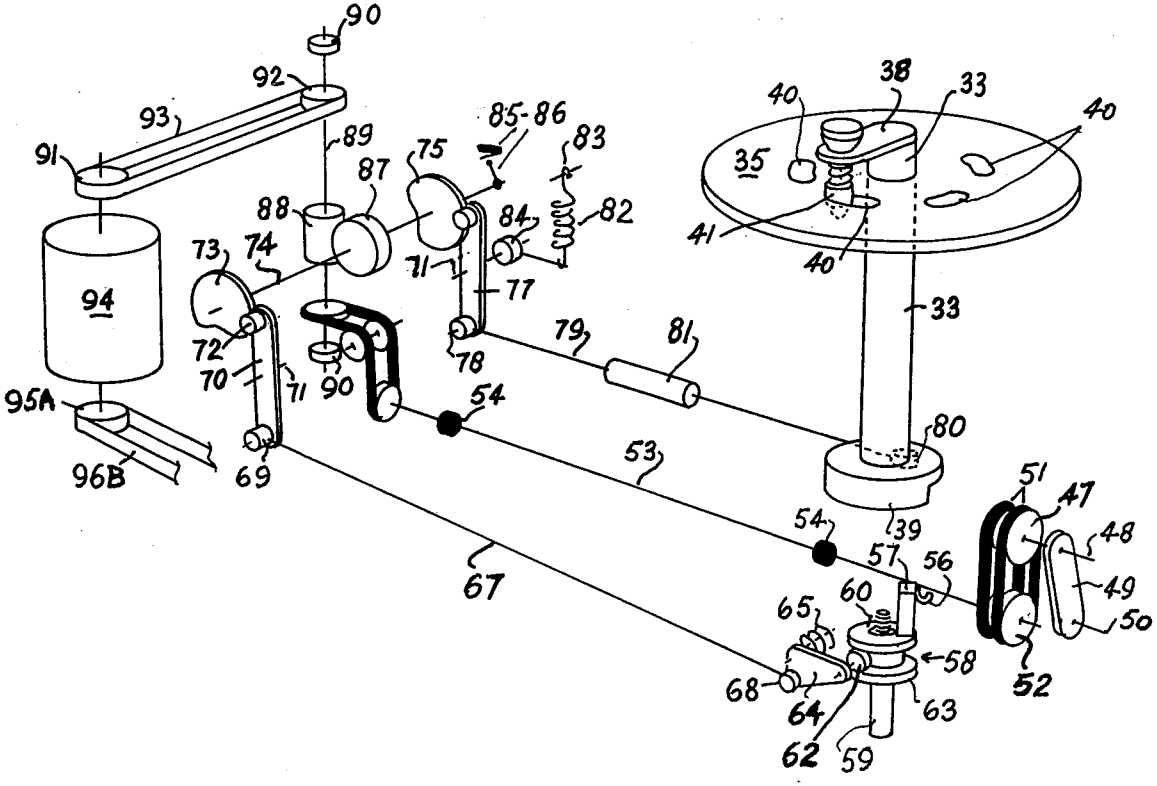
FIG. 3 is a schematic view showing the location and operating function of the various components of the machine.

The turret head 35 has six curved slots 40 formed therethrough, (FIG. 3). The positioning handle 38 supports a spring urged plunger 41 which is adapted to be selectively positioned in a selected one of the slots 40 according to which spindle 36 is to be located in engagement with the paper drive rollers 30. Also, the turret 31 is spring biassed to retain the selected spindle 36 in engagement with the drive rollers and is movable towards and away from said rollers 30.

The spindles 36 are each of a different diameter. The said diameter is predetermined according to the diameter of a paper tube T which is to be formed thereon. The paper guides 37 (FIG. 1) include a plurality of fingers 42 formed integrally thereon, which partly surround the spindles 36. The fingers 42 function as guides for paper being fed to the spindle 36 engaged by the paper drive rollers 30, for forming a tube T.

Figure 5:
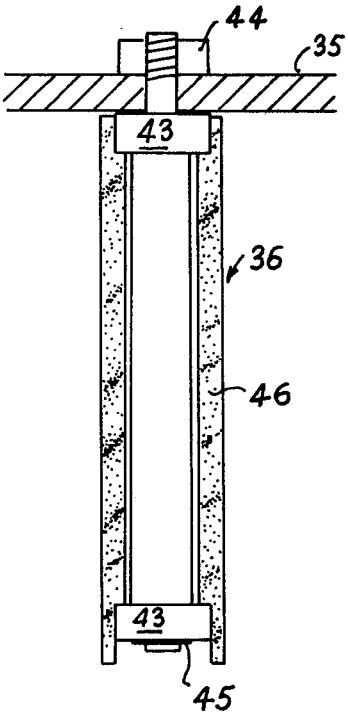
FIG. 5 is a sectional view of a tube forming spindle, also showing its mounting in the turret.

With particular reference to FIG. 5, each tube forming spindle 36 comprises an assembly of an axial centre pin having a pair of rollers 43 mounted thereon adjacent each end thereof. At its upper end, the centre pin is extended above the upper roller 43 and is externally screw threaded, whereby it is secured by a nut 44 to the turret head 35. At its lower end, the lower roller 43 is retained on the centre pin by a circular clip 45. A cylindrical, tubular roller sleeve 46 formed from any suitable material is mounted in the rollers 43 and for this purpose, the sleeve 46 is stepped at each end as indicated in the drawing.

Also, it is preferred to taper the sleeve 46 downwardly inwardly, to facilitate removal of a formed paper tube therefrom. The amount of taper is comparatively small, for example 1/64" O.D. reduction throughout the length of the sleeve and the taper serves to allow a formed paper tube, when engaged by tube ejection mechanism to be explained, to immediately release without creasing, from a sleeve 46.

An ejector pulley 47 (driven pulley shown in FIGS. 1, 3, 7, 8), is mounted on a shaft 48 supported in the cabinet. The shaft 48 also supports the upper end of a lever 49 (FIG. 3), the lower end of which is mounted on a shaft 50 also supported in the cabinet. The pulley 47 is connected by a belt or belts 51 to a drive pulley 52 mounted on an ejector shaft 53 supported in bearings 54 in the cabinet beneath the floor 6. The driven pulley 47 is located above the floor 6 as particularly seen in FIG. 1 and the belt or belts 51 pass through the opening 9 formed in said floor 1. Also, the shaft 48 is suitably supported in bearings (not shown).

A crimping hook 56 (FIG. 3) is supported upon an upwardly projecting finger 57 fixed upon a hook support assembly 58 which includes a shaft 59 which is vertically slidably supported in the bottom of the cabinet 1. The crimping hook 56 is located above the floor 6 and for this purpose the finger 57 projects through the opening 9 in floor 6.

The crimping hook support assembly 58 includes the mentioned finger 57 and a pair of vertically spaced roller guides 60 and 63. One, upper guide 60, has the finger 57 fixed to and projecting upwardly therefrom and it is moved up and down by a roller 62 carried by a bell-crank lever 64. The fixed limb (fulcrum) of the bell-crank 64 includes a spring 65 biasing the bell-crank downwardly to an inoperative position. The other limb of the bell-crank 64 is adapted to be actuated to raise upper guide 60 against the action of spring 65 and to move the crimping hook 56, by means of a crimping link 67 and roller 68.

The crimping link 67 is connected via roller 69 to a lever 70 fulcrummed at 71 within the cabinet 1 and the other end of lever 70 supports a cam follower 72 which engages a crimping cam 73 carried by a cam shaft 74 also supported within the cabinet 1.

The cam shaft 74 also carries a turret cam 75. Cam 75 is engaged by a cam follower carried by a lever 77 also fulcrummed at 71 within the cabinet 1 and the lever 77 is connected via roller 78 and turret link 79 to a ball joint 80 for example, carried by the turret body 37. The turret link 79 is length adjustable as indicated at 81 and in addition, a turret return spring 82 supported at one end 83 within the cabinet 1, is connected at its other end to a roller 84 supported upon fulcrum shaft 71, to normally bias the turret 31 to a position where a selected one of the tube forming spindles 36 engages the paper drive rollers 30. The cam shaft 74 also carries an actuator 86 for an electric switch 85. The switch 85 is in series with a second switch.

The cam shaft 74 supports and is driven by a worm wheel 87 engaged by a worm gear 88 carried on a driven shaft 89 supported vertically in bearings 90 within the cabinet 1. The shaft 89 is driven by an arrangement of pulleys 91-92 and belt 93 by a drive motor 94. The motor 94 also drives, via pulley 95A and belt 96B, the pulley 18 (FIG. 4 and FIG. 4A) and the paper feed roller shaft 16, and thence via pulleys **18*a*, 18*b* and belt 96*a* (FIG. 4), the paper drive roller shaft 29**.

A paper cutting knife 95 is supported by a bracket 96 fixed to the paper guide and by a rod indicated at 97 carried by the paper feed roller shaft 15, in such a way that cutting knife 95 may be positioned to lengthen or shorten the paper to be cut as required for different paper tube diameters. The cutting knife 95 has an angled cutting edge with serrated cutting teeth 98 thereon so as to cut the paper 7 at an angle to provide a pointed corner on the lower trailing edge of the length of paper which is to be formed into a tube.

In addition to the driving motor 94, the cabinet 1 houses a paper feed motor 99 (FIG. 2), a gear box 100 (FIG. 2) which incorporates the cams 73, 75 (FIG. 3), and control electronics 101 (FIG. 2) for all of the foregoing. From FIG. 2 it will be observed that the paper roll rotates in a clockwise direction as indicated by the arrow PF and paper 7 is fed therefrom in the direction of the arrows PF1 and PF2. The turret 31 is rotated in an anticlockwise direction as indicated by the arrow TR for setting a selected spindle 36 in operating relationship with the paper drive roller 30 and is rotatable in both directions to bring said selected spindle 36 into engagement with the paper drive roller 30 or with the tube ejection belt 51 as indicated by the arrow E-D.

In operation, the paper feed is held "ON" until paper 7 has been advanced to just short of a take-up position and at this point the forward motion of the paper opens a switch turning off the paper feed. This switch is in parallel with switch 85 controlled by shaft 74.

When the machine is ready to form a tube T, this latter switch 85 is closed and the paper 7 is advanced to the take-up position. The switch 85 on the cam shaft 74 is in series with another switch which detects if a tube T, or piece of paper 7 is still on the spindle, and if this is the case the paper feed will not advance and the machine will keep cycling until the obstruction is clear.

The paper knife 95, as stated, has its cutting edge angled to the vertical so as to cut the paper 7 at an angle to give a pointed corner on the lower trailing edge of the paper 7; which is tucked in when the tube T is crimped. Also, as stated, the knife 95 is pivoted to allow the position of the cutting edge 98 to be moved thus lengthening or shortening the paper 7 to be cut off, as required for the different tube diameters.

A tube T is formed by wrapping the paper 7 around the spindle 36. The paper 7 is propelled by the drive rollers 30 engaging the spindle 36, and is guided by paper guide fingers 42 around the spindle 36. The guide fingers 42 are arranged so as to fit between the drive rollers 30. Thus, the paper 7 cannot miss the guide fingers 42 as it is fed in.

Figure 6:
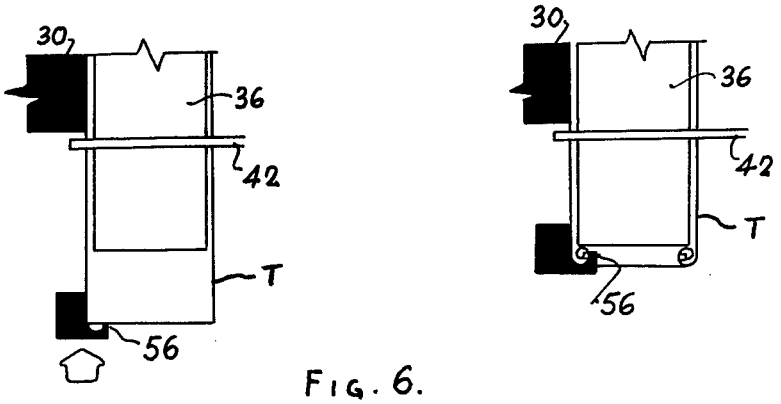
FIG. 6 shows schematic detail views of tubes forming and crimping operations.

The formed tube T is crimped by rolling the bottom edge in, whilst the tube T is rotating, see FIG. 6, to form a curl or roll C on each tube T for coins, during subsequent forming of the tube T. The crimping also holds the tube T together.

The machine operates as follows:

1. Paper 7 is fed off the roll in a curved path around the paper knife 95 to a point just short of the take-up position.

2. When the machine is in the correct state to start making a tube T, the paper 7 is advanced to the take-up position at a point between the spindle 36 and drive rollers 30.

3. The spindle 36 and drive rollers 30 are rotating at approximately 1500 rpm and are in close contact with each other. On contact, the paper 7 is rapidly accelerated to over 2 meters per second and is pulled into a straight line between the spindle 36 and the paper knife 95 and the paper is severed. This action cuts sufficient paper off the roll for manufacturing one tube T.

4. The severed length of paper is guided around the spindle 36 by the shaped paper guide fingers 42 to form a tube T.

5. The paper feed is now turned on to advance the paper for a second tube T.

Figure 7:
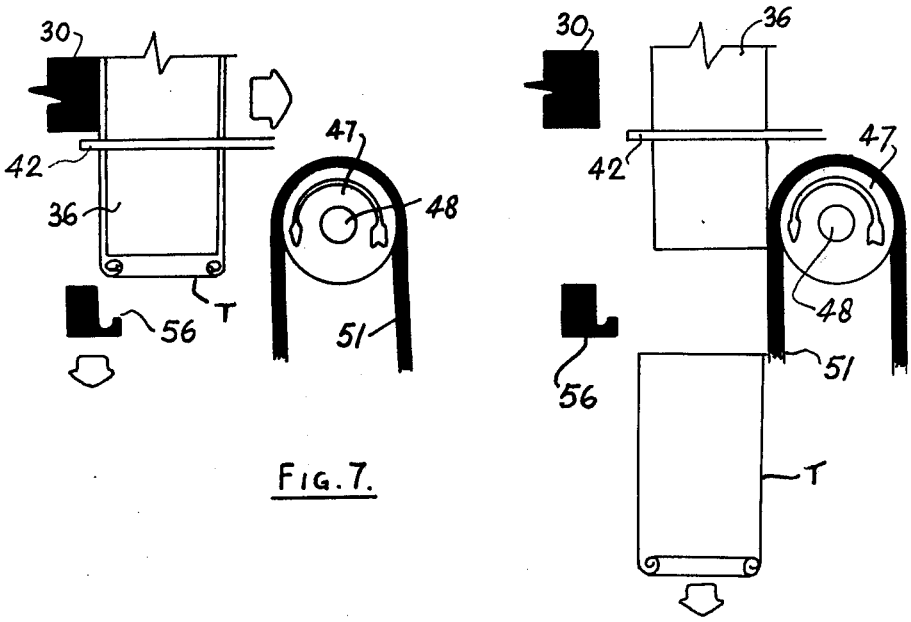
FIG. 7 shows similar views of the operations of moving the turret from a position where a tube has been formed and crimped, to the position of tube ejection.
Figure 8:
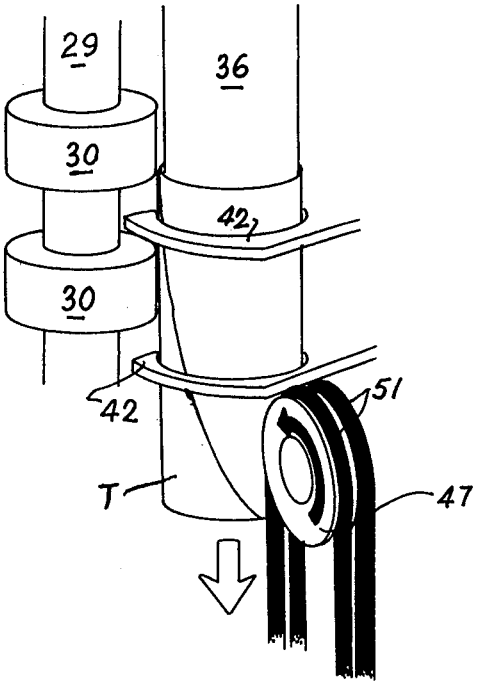
FIG. 8 is a detail, fragmentary perspective view showing a formed tube being ejected from the machine.

6. As the crimping finger 56 retracts the turret 31 is rotated slightly in order that the spindle 36 will break contact with the drive rollers 30 and make contact with the ejector belt(s) 51 (which is/are always driving), so as to eject the first tube T through the bottom 10 of the machine. This operation is illustrated in FIG. 7.

7. The turret 31 now returns to its original position ready to form and crimp the next tube T and the cycle of operations continues.

I claim:

1. A machine for manufacturing paper tubes comprising means for rotatably mounting a roll of paper, paper feed rollers arranged in juxtaposition to said mounting means for the roll of paper, a rotatable turret, at least one tube forming spindle carried by said turret, said turret being rotatable to move said spindle to a tube forming position;

a paper drive roller in juxtaposition to the position of said tube forming spindle when in said tube forming position, said paper drive roller being normally in working engagement with said spindle to engage and drive the paper between said roller and said spindle, a rotatable tube ejection means arranged in juxtaposition to said tube forming spindle, said turret being rotatable to move said spindle away from said tube forming position and out of engagement with said paper drive roller into a tube ejection position in engagement with said ejection means, said ejection means having a surface engagable with the outer cylindrical surface of said spindle and thus with a formed tube carried thereby and moving in a direction substantially parallel to the axis of said spindle for ejection of a formed tube from said spindle, said turret then being rotatable in the opposite direction to move said spindle away from said ejection means and back to engagement with said drive roller.

2. A machine as claimed in claim 1 wherein there is provided a fixed paper guide positioned adjacent to said paper feed rollers, said paper guide being operable to guide paper from said paper feed rollers to said spindle in said tube forming position, and a paper cutting knife mounted between said paper guide and said tube forming position of said spindle.

3. A machine according to claim 2, wherein said turret supports a plurality of tube forming spindles of different diameters, said turret being selectively rotatable in one direction to position a selected one of said tube forming spindles at the tube forming position.

4. A machine according to claim 3, wherein said turret includes a plurality of spaced-apart paper guides, each of said paper guides including fingers partly surrounding the tube forming spindles, said fingers being located and arranged to guide paper from the fixed paper guide around the selected tube forming spindle.

5. A machine according to claim 2, wherein the cutting knife is pivotally adjustably mounted in the housing whereby the length of paper to be severed by said knifed way be selectively varied.

6. A machine according to claim 5, wherein the cutting knife includes a tapered cutting edge arranged to cut the paper at an angle to form a pointed corner on the trailing edge of a cut length of paper.

7. A machine according to claim 2, wherein said turret include at least one paper guide, said paper guide including a finger partly surrounding said tube forming spindle, said finger being positioned and arranged to guide paper from said fixed paper guide around said spindle.

8. A machine as claimed in claim 1 wherein there is provided a tube crimping hook positioned adjacent to said tube forming position of said spindle and operable for to and fro axial movement with relation to said spindle for engagement with the edge of a paper tube formed on said spindle and for retraction from engagement with the tube.

9. A machine as claimed in claim 1 wherein said rotatable tube ejection means comprises a pulley wheel and a belt rotatable upon said pulley wheel.

10. A machine as claimed in claim 9 wherein said pulley wheel is a double pulley wheel and wherein two belts are provided upon said pulley wheel and arranged in parallel thereon.

11. A machine as claimed in claim 9 wherein said rotatable tube ejection means includes a second pulley wheel coplanar with said last-mentioned pulley wheel and concurrently rotatable within said belt, the outer peripheral surface of said belt in the straight section between said pulley wheels being essentially parallel to the axis of said spindle.

* * * * *